US006296052B1

(12) United States Patent
Sidwell

(10) Patent No.: US 6,296,052 B1
(45) Date of Patent: Oct. 2, 2001

(54) COMPRESSOR LIFT SYSTEM FOR GAS WELL PRODUCED LIQUIDS

(76) Inventor: Herbert R. Sidwell, 15341 W. Little York Rd., Houston, TX (US) 77084

( * ) Notice: Subject to any disclaimer, the term of this patent is extended or adjusted under 35 U.S.C. 154(b) by 0 days.

(21) Appl. No.: 09/528,860

(22) Filed: Mar. 20, 2000

(51) Int. Cl.[7] ..... E21B 43/16; E21B 43/12
(52) U.S. Cl. ..... 166/53; 166/250.15; 166/372
(58) Field of Search ..... 166/372, 319, 166/133, 188, 250.15, 53

(56) References Cited

U.S. PATENT DOCUMENTS 3,941,510 * 3/1976 Morgan ..... 417/57
4,267,885 * 5/1981 Sanderford ..... 166/53
4,405,291 * 9/1983 Canalizo ..... 417/393
4,480,697 * 11/1984 Goldaniga et al. ..... 166/372
5,806,598 * 9/1998 Amani ..... 166/372
5,857,519 * 1/1999 Bowlin et al. ..... 166/105.5

* cited by examiner

*Primary Examiner*—Hoang Dang
(74) *Attorney, Agent, or Firm*—Robert K. Rhea

(57) ABSTRACT

An axial assembly of pistons is axially disposed in the depending end of tubing in a gas well and packer set above the formation. Gas and fluid from the production zone enters the casing through an orifice below the piston assembly. Fluid in the annulus between the tubing and the casing creates a static head of back pressure against the orifice resulting in decreasing the gas pressure at the well head or flow line, which is sensed by pressure sensors to energize a compressor generating gas under pressure forced down the tubing to move piston rods and close the orifice. The gas pressure lifts the fluid in the annulus to the well head and flow line connected therewith. This cycle is repeated each time gas pressure falls below a predetermined pressure at the well head or flow line.

3 Claims, 3 Drawing Sheets

COMPRESSOR LIFT SYSTEM FOR GAS WELL PRODUCED LIQUIDS

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to the oil and gas industry and more particularly to a compressor operated piston system for removing fluid build up in a gas well hampering the production of the gas from the well. As is well known in the industry, some gas wells produce fluids. Fluid build up in the casing of a gas well results in a static head hampering or shutting off production of gas from earth formations or perforations in the casing. Therefore many different apparatuses have been employed to remove such fluid, such as a gas lift system or as by pumping, neither being entirely satisfactory.

This invention on the other hand provides an automatic operating system responding to gas pressure sensors and an axial piston assembly which removes fluid from the well bore casing permitting commercial production of gas to the fullest extent possible of a particular gas well.

2. Description of the Prior Art

I do not know of any patents or publications disclosing the apparatus of this invention.

BRIEF SUMMARY OF THE INVENTION

An axial assembly of pistons is axially attached to the depending end of tubing in a gas well and set above the formation or casing perforations. Fluid from the production zone enters the casing through an orifice at the depending end of the piston assembly. The piston assembly in an open position allows fluid from the production formation, after passing through the orifice, to enter the annulus between the tubing and the casing. Fluids in the flow stream separate and settle to the depending limit of the casing and create a static head of back pressure against the orifice which results in decreasing the gas pressure at the well head. This decrease in gas pressure is detected by pressure sensors which releases compressed gas from a recycling tank on the surface of the earth which enters the tubing and forces pistons in the piston assembly downward. The several pistons in the piston assembly multiplies the force of the recycling tank gas pressure so that the injected gas passes outwardly of the piston assembly through exit ports in the depending end thereof and enters the annulus under the trapped liquid in the annulus around the tubing to lift it to the surface of the earth while simultaneously closing the orifice and preventing any loss of injected gas into the earth formation. When the accumulated liquid in the casing annulus has been removed a pressure sensor opens a closed valve in the gas injection line and gas pressure generated by a compressor is directed to the recycling tank while the gas production enters the flow line connected with the gas well head, thus completing one cycle of operation which is automatically repeated when fluid build up in the casing annulus subsequently occurs.

The principal object of this invention is to provide a compressor lift system employing a series of axially connected pistons periodically removing fluid build up in a gas well casing annulus in response to gas well pressure sensors controlling the operation of a compressor and gas recycling tank.

DETAILED DESCRIPTION OF THE INVENTION

Figure 1:
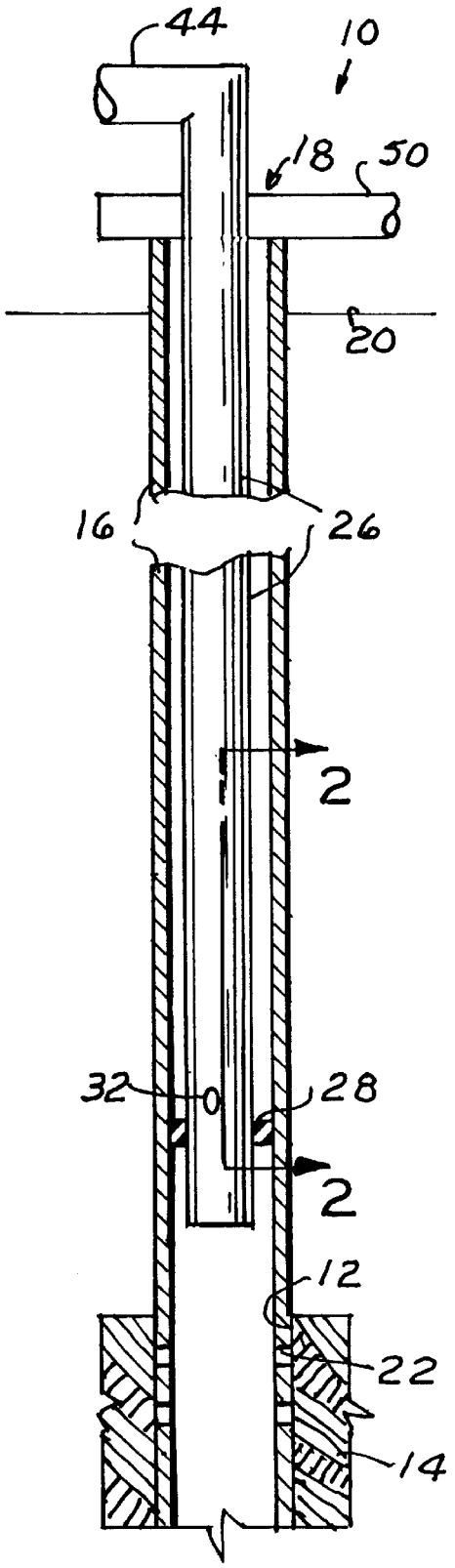
FIG. 1 is a fragmentary diagrammatic view of a producing gas well.
Figure 4:
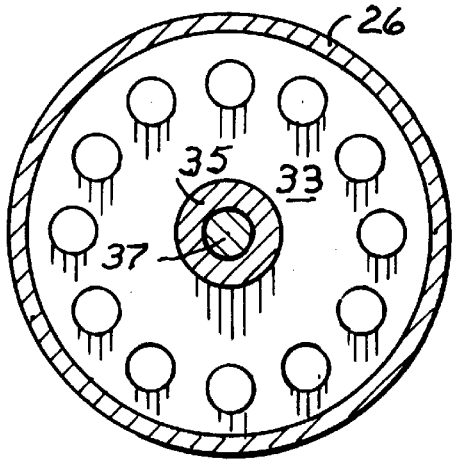
FIG. 4 is a top view of a spacer looking in the direction of the arrows 4—4 of FIG. 2; and, FIG. 5 is a diagram of system components.
Figure 3:
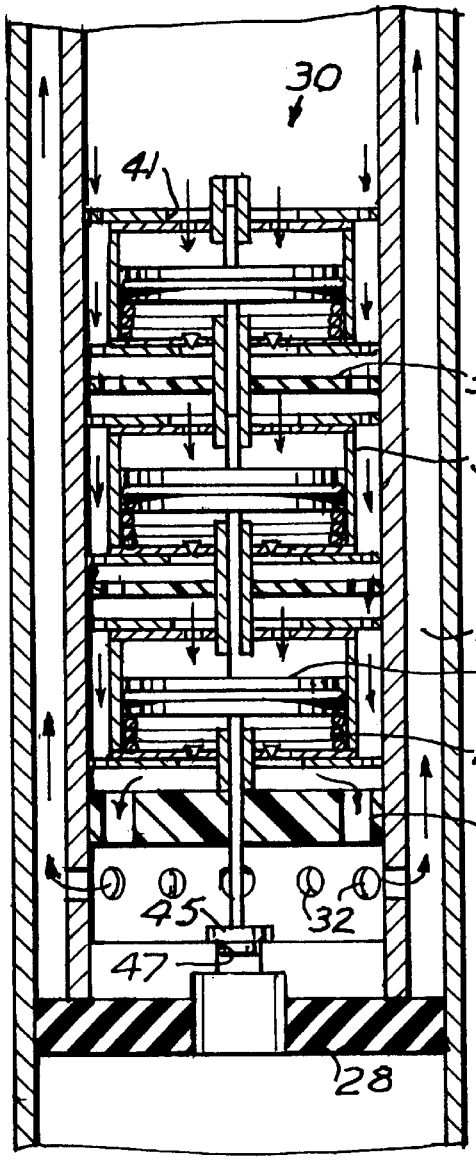
FIG. 3 is a similar cross section view in piston closed position.

Description of preferred embodiment.

DETAILED DESCRIPTION OF THE INVENTION

Like characters of reference designate like parts in those figures of the drawings in which they occur.

In the drawings:

The reference numeral 10 indicates a producing gas well having a bore hole 12 terminating in or passing through a gas producing zone 14 and containing a length of casing 16 having a well head 18 at its upper end projecting above the surface of the earth 20. Gas, not shown, from the earth formation 14 enters the casing through its depending end or through perforations 22 in the casing wall. The well head 18 is normally connected with a tank or other apparatus receiving gas produced by the well 10 by a flow line 50.

As mentioned hereinabove, such a gas well produces fluid, not shown, which also enters the depending end portion of the casing 16 with the gas and results in a static head of water accumulating in the depending end of the casing which at least hampers or stops the gas from entering the tubing. It is such a gas well that the apparatus of this system is intended to alleviate the fluid problem.

Figure 2:
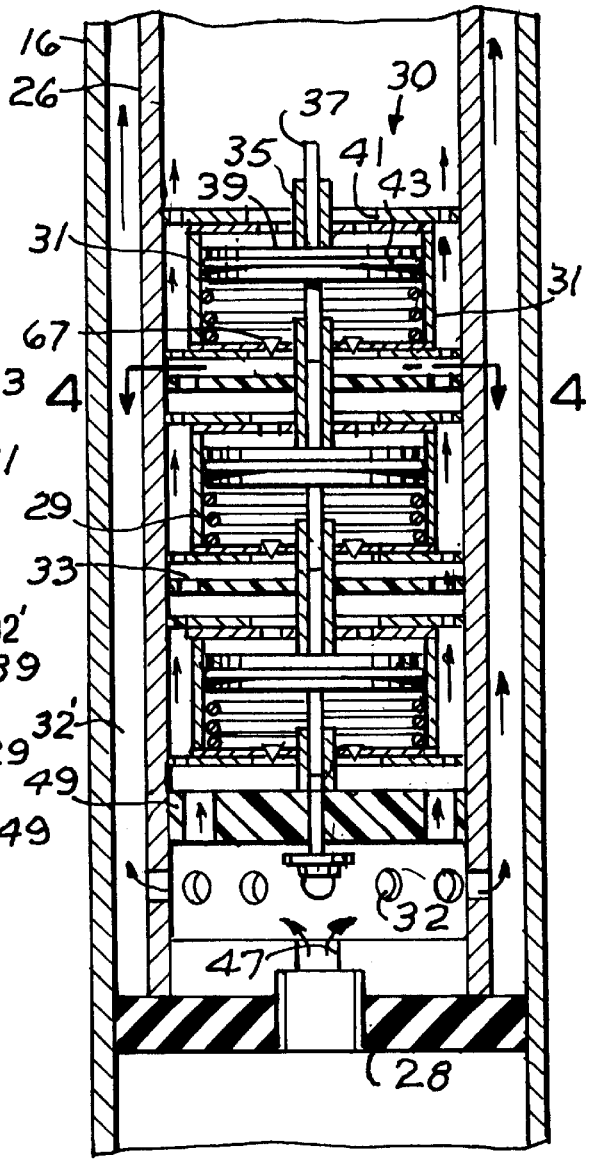
FIG. 2 is a fragmentary vertical cross-section view 1; of a piston assembly in open position taken substantially along line 2—2 of FIG. 1.

This is accomplished by installing a string of tubing 26 in the casing 16 with a packer 28 at its depending end which is set in the casing 16 at a point above the gas production zone 14. A series of axially connected superposed pistons, indicated at 30 (FIG. 2), are installed in the tubing 26 above perforations 32 in the tubing wall spaced above the packer 28 and below the lowermost limit of the series of pistons 30.

Figure 5:
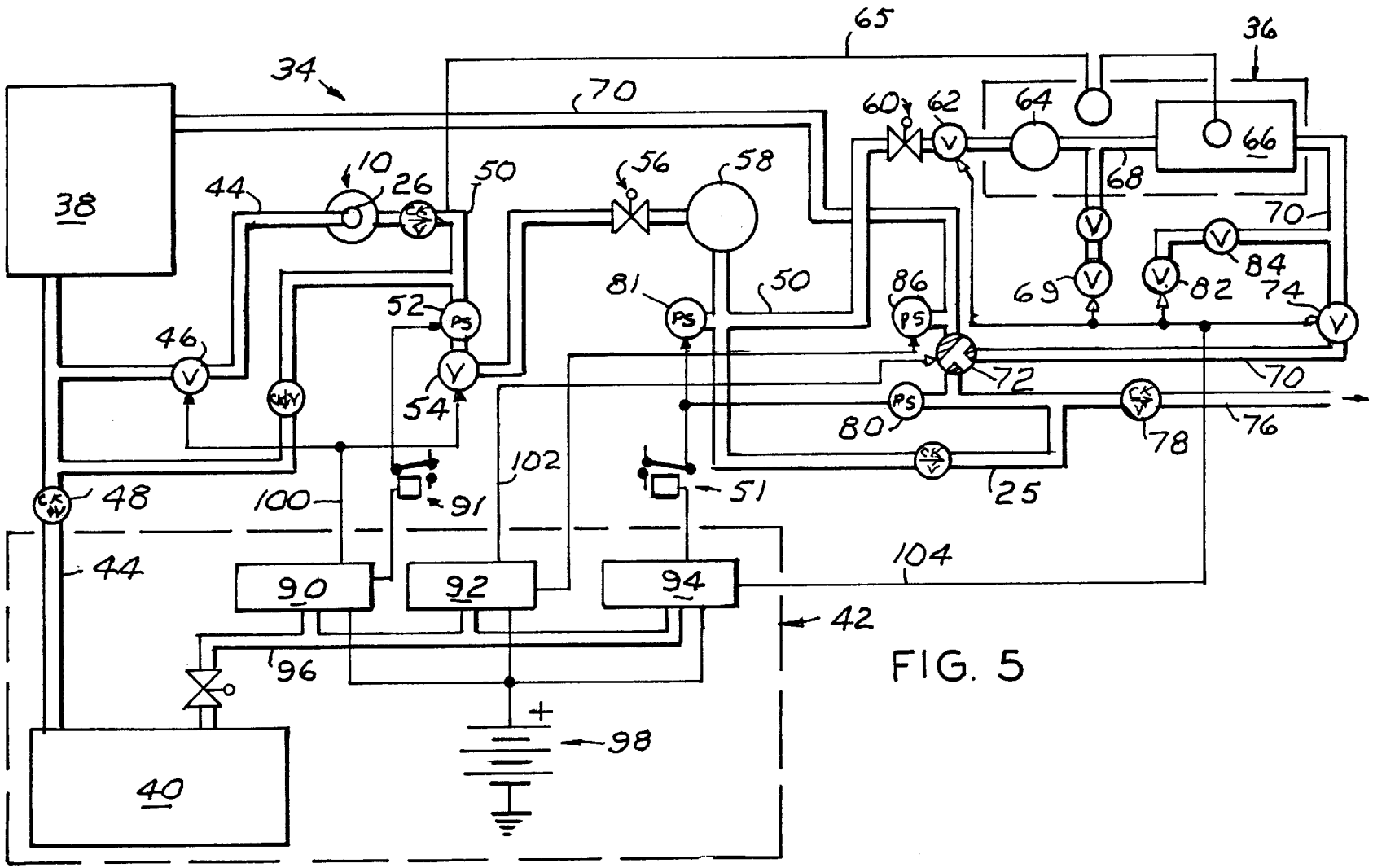

Operation of the several pistons 30 is accomplished by control apparatus 34 (FIG. 5). The control apparatus includes a compressor unit 36, a recycling gas tank 38, a pressure supply gas tank or reservoir 40 and an electrical control system 42 and several interconnected components such as valves, pressure sensors and air lines for opening and closing various valves in sequence for operation of the system as will now be described.

A pipe line 44 is connected at one end with the gas well tubing 26 through an air valve 46 and a check valve 48 to the pressure supply tank 40. The well casing 16 is connected with the air compressor unit 36 by a tubular line 50 through a pressure sensor 52, an air valve 54, a regulator 56, a separator 58, a pressure regulator 60 and an air valve 62 and a compressor 66. The compressor unit 36 includes a scrubber 64 communicating with the air valve 62 and the gas compressor 66 by a tubing line 68 having a normally closed valve 69 connected with the tubing line 68. Compressed gas from the compressor 66 is connected to the recycling tank by a tubular line 70 through a three-way valve 72 and a discharge valve 74. An outlet of the three-way valve is also connected to the gas sales or discharge line 76 through a check valve 78. The discharge line 76 is also connected with a pressure sensor 80 upstream from the check valve 78. The compressor discharge line 70 is provided with a lateral line open to the atmosphere through a normally closed valve 82 and a normally closed manually opened valve 84. A pressure sensor recycling tank pressure switch 86 is connected with the compressor discharge line 70 adjacent the three-way valve 72. Gas line 70 is provided with a branch line 25 connecting the separator 58 with the gas sales line 76 downstream with respect to the three-way valve 72 and upstream with respect to the check valve 78.

The electrical control system 42 includes solenoids 90, 92 and 94 connected in parallel with the pressure supply tank 40 by other tubing 96. A bank of batteries 98 includes necessary wiring connecting the electrical energy with the respective solenoid. Solenoid 90 is connected by an air line 100 with the valves 46 and 54, and solenoid 92 is connected by an air line 102 with the three-way valve 72, while the solenoid 94 is connected by a line 104 with the air valves 62, 69, 82, and 74 for opening or closing these valves as presently explained.

OPERATION

In operation the compressor 66 is started by utilizing gas from the well head 18 via a bypass line 65 or a propane starter tank supply, not shown. The electrical control panel 42 controls all functions of the compressor as dictated by well head and discharge gas pressure in the well gas line 76 by responding to changes in preset parameters for operating the gas well 10. Assuming the pressure in line 50 is not above the discharge set point, as controlled by pressure switch 80 or the low pressure set point of pressure switch 81, the normally closed pneumatic valves 62 and 74 will open while the normally closed valves 69 and 82 will close. This is accomplished by the pressure supplied by the gas well 10 through the line 44 into the air pressure supply tank 40. The pneumatic pressure supply tank 40 allows the gas to pass from normally open solenoid 94 through tubing line 104 to open valves 62 and 74 and close valves 69 and 82. When the well pressure in line 50 is above the set point of pressure switch 52, the solenoid 90 is excited and opens valve 54 and simultaneously closes valve 46. Gas flows through pneumatic valve 54 and regulator 56 through the compressor scrubber 58, regulator 60 and valve 62 into the compressor unit 36. Compressed gas flows through the sales line 70, normally open valve 74 and the three-way valve 72, to the recycling tank 38. When the recycling tank 38 is at preset pressure point, pressure switch 86 excites solenoid 92 and diverts gas flow through the three-way valve 72 to the sales line 76. The compressor 66 will continue pumping gas until there are pressure changes in the system. In the event pressure in the sales pipe line 76 exceeds set pressure point, the pressure switch 80 excites the solenoid 94 to close valves 62 and 74. Simultaneously, pressure release opens the valves 69 and 82 to atmosphere, allowing the compressor 66 to run in idle mode by circulating air and keeping the compressor running. Pressure switch 80 or 81 activates solenoid 94. The delay relay 51 allows the compressor 66 to shift to the idle position and recycle to atmosphere for a predetermined time. After the time interval elapses, solenoid 94 will return to its normally open position. However, if the suction pressure or the discharge of the compressor 66 remains out of set point range, solenoid 94 will automatically be reversed again by pressure switch 80 or 81 before the pneumatic valves have time to change their position. This action will be repeated until the intake or discharge pressure falls to the acceptable pressure range. Should the well have a sudden slug or surge while the compressor 66 is in the idle mode the gas may pass through the bypass line 25 and into the sales line 76. When the well head pressure decreases as the result of liquid in the bore hole, and the result of this liquid in line 50, the pressure drops below the set point of pressure switch 52, and excites solenoid 90 to close valve 54 and open valve 46 allowing the pressurized gas in the recycling tank 38 to enter the well tubing 26 through line 44, putting pressure on the piston assembly 30.

The piston assembly 30 consists of a series of independent axially connected piston housings, as mentioned hereinabove, separated from each other by apertured partitions 33 which are cylindrical with apertures adjacent its periphery and containing a central threaded bore to axially attach the piston housings 31 to each other and the piston stem guide 35. The spacers also align each piston guide 35 and pistons 39 with each other, allowing each piston stem 37 to extend axially as the depending piston 39 is moved downwardly by the gas being injected into the well tubing 26. The injected gas enters the top of each piston housing 31 through port holes 41. As the injected gas enters in the piston assembly 30, it places pressure on the top of each piston 39. This pressure causes the piston 39 enclosed in each piston housing 31 to move downward against its return spring 29 placing axial pressure on its stem 37 and axial pressure of the stem 37 on the depending piston in the attached piston housing. Each piston 39 is sealed by an O-ring 43. This action multiplies the force of the gas being injected from the recycling tank 38 by the surface area of the combined pistons 39, thus enabling the force being injected into the piston housing to oppose a much larger force, and close the lowermost piston stem 45 on the packer seat 47 preventing gas and liquid from the producing formation 14 entering the piston assembly 30. By closing the orifice 47 to the production formation of the well, the gas being injected will exit the well tubing port holes 32 and enter the annulus 32' between the tubing 26 and the well casing 16.

The apparatus control valve 54 is closed during gas injection from the recycling tank 38. The injection period is closed by the preset time delay relay 91 in the electric control system 42. At the end of time delay, the valve 54 is opened and injected gas and liquid exit the well head 18.

The injected gas is restricted from returning to the piston assembly by check valve 49 during the cycling process. One-way bleed valves 67 in the bottom of each piston housing 31 allows each piston to move downward. The one-way bleed valves 67 allow any air or gas trapped in the lower chamber of the piston housing to bleed off. The remaining downward pressure on the piston assembly 31 is dissipated by the time delay of relay 91, holding open the valve 46 which allows the injected pressure to dissipate back into the recycling tank 38. This cycle is repeated each time the static head of the liquid is sufficient to lower the well head pressure.

Obviously the invention is susceptible to changes or alterations without defeating its practicability. Therefore, I do not wish to be confined to the preferred embodiments shown in the drawings and described herein.

I claim:

1. An auxiliary fluid lift system for a well normally producing gas under greater than atmospheric pressure from a natural gas producing formation and having a string of casing depending from a well head, connected with a gas flow line, into a borehole admitting gas and fluid into the depending end portion thereof and having a string of tubing depending from the wellhead into the casing and supported at its depending end portion by a packer sealing with the inner wall surface of the casing above the entrance of gas and fluid and defining a casing annulus around the tubing communicating with the tubing interior adjacent the packer, the combination comprising:

a plurality of pistons axially disposed in the depending end portion of the tubing and having axially connected piston rod means, vertically movable as a unit relative to the pistons, for admitting or blocking gas and fluid entry into the casing annulus;

gas compressor means interposed between and communicating with the well head and the gas flow line through valve equipped conductors; and, control means including well head and flow line gas pressure sensing means connected with the compressor means and conductors for energizing said compressor means from a source of gas under pressure in response to a predetermined decrease of gas pressure in the well head or flow line and forcing gas under greater than atmospheric pressure into the tubing at the well head for forcing the piston rod means downwardly to close the gas and fluid entrance and force accumulated fluid from the casing annulus into the flow line.

2. The fluid lift system according to claim 1 in which the control means further includes:

pneumatic valve means interposed in the conductors and opened and closed in accordance with predetermined gas pressures in the well head and flow line for placing the compressor means in idle mode by recycling to atmosphere and closing the casing at the well head until the gas well regains an operating gas pressure.

3. The fluid lift system according to claim 2 in which the control means further includes:

a source of electrical energy; and, electrical control means for operatively connecting the source of electrical energy with electrical components.

* * * * *